US008274450B2

(12) United States Patent
Abdoulin

(10) Patent No.: US 8,274,450 B2
(45) Date of Patent: Sep. 25, 2012

(54) CURRENT SENSING BI-DIRECTIONAL SWITCH AND PLASMA DISPLAY DRIVER CIRCUIT

(75) Inventor: Edgar Abdoulin, Woodland Hills, CA (US)

(73) Assignee: International Rectifier Corporation, El Segundo, CA (US)

( * ) Notice: Subject to any disclaimer, the term of this patent is extended or adjusted under 35 U.S.C. 154(b) by 1142 days.

(21) Appl. No.: 12/136,482

(22) Filed: Jun. 10, 2008

(65) Prior Publication Data

US 2008/0238904 A1 Oct. 2, 2008

Related U.S. Application Data

(62) Division of application No. 10/853,980, filed on May 25, 2004, now Pat. No. 7,403,200.

(60) Provisional application No. 60/475,180, filed on May 30, 2003.

(51) Int. Cl.
*G09G 3/28* (2006.01)

(52) U.S. Cl. ..... 345/60; 345/204

(58) Field of Classification Search ..... 345/204, 345/60

See application file for complete search history.

(56) References Cited

U.S. PATENT DOCUMENTS

2003/0122735 A1* 7/2003 Huang et al. ..... 345/60

FOREIGN PATENT DOCUMENTS

| | | |
|---|---|---|
| JP | 4-296116 A | 10/1992 |
| JP | 6-130914 | 5/1994 |
| JP | 9-186573 A | 7/1997 |
| JP | 11-97186 A | 4/1999 |
| JP | 11-299250 A | 10/1999 |

* cited by examiner

*Primary Examiner* — Amare Mengistu
*Assistant Examiner* — Joseph G Rodriguez
(74) *Attorney, Agent, or Firm* — Farjami & Farjami LLP

(57) ABSTRACT

A discharge sustain driver circuit for a plasma display device, the driver circuit comprising a first transistor switching circuit for switching a DC bus voltage across the plasma display device; a storage capacitance; at least one inductor; and first and second bi-directional switching circuits coupled in series and being coupled to the first switching circuit to transfer charge from the plasma display device through the at least one inductor to the storage capacitance, and back to the plasma display device; and a controller for the bi-directional switching circuits to control the bi-directional switching circuits so as to receive the charge on the storage capacitance and return the charge in an opposite charge direction to the plasma display device.

23 Claims, 7 Drawing Sheets

CURRENT SENSING BI-DIRECTIONAL SWITCH AND PLASMA DISPLAY DRIVER CIRCUIT

CROSS REFERENCE TO RELATED APPLICATION

This is a divisional of U.S. patent application Ser. No. 10/853,980, filed May 25, 2004 entitled CURRENT SENSING BI-DIRECTIONAL SWITCH AND PLASMA DISPLAY DRIVER CIRCUIT, which application claims the benefit and priority of U.S. Provisional Patent application Ser. No. 60/475,180 filed May 30, 2003 entitled "CURRENT SENSING BI-DIRECTIONAL SWITCH FOR PDP APPLICATIONS", the entire disclosure of which is incorporated by reference herein.

BACKGROUND OF THE INVENTION

The present invention relates to switching circuits, and more particularly, to a current sensing bi-directional switching circuit and even more particularly, to a current sensing bi-directional switching circuit for plasma display applications. The present invention relates to a current sensing bi-directional switch and a sustain driver circuit for plasma display devices using the bidirectional switch.

Plasma display devices are gaining popularity because they are flat screen display devices. Currently, plasma display panel (PDP) devices are used for many display applications including television monitors and receivers and computer monitors. In a plasma display device of the AC type, an AC voltage, typically of approximately 180 volts, is provided to the display device. When the display device discharges it can only do so for a limited period of time. In order to sustain the discharge, an AC signal can be provided to the PDP device to sustain the discharge. A PDP device is essentially capacitive, so it is necessary to quickly provide the alternating current voltage to the PDP to sustain the discharge. Accordingly, the PDP must be charged and discharged repeatedly with the AC signal which reverses the voltage across the PDP at a periodic rate.

Currently, typical PDP sustain drivers utilize at least two capacitors to store a charge developed across the PDP from the B plus voltage and a number of transistor switches and diodes as well as at least two inductors to periodically reverse the charge across the PDP.

Typically, such PDP sustain drivers incorporate a full bridge driver, two inductors and two additional switching circuits connected to charge storage capacitors to store the charge and allow it to be reversed.

With reference to FIG. 1, a typical prior art PDP sustain driver is shown. The PDP device, being primarily capacitive, is indicated by the capacitor Cp. The capacitor Cp is connected to the outputs of a full bridge driver 10 comprising transistors Q3, Q4, Q7 and Q8. The full bridge driver is connected between the B plus source, typically 170 to 180 volts DC and ground. The full bridge driver outputs, which are connected across the PDP device indicated by Cp, are also connected through inductors L1 and L2 to respective charge storage circuits 12 and 14. Once charge storage circuit 12 comprises transistors Q1 and Q2, diodes D1 and D2 and the charge storage capacitor C1. The other charge storage circuit 14 comprises transistors Q5 and Q6, diodes D3 and D4 and the charge storage capacitor C2. In addition, diodes D5, D6, D7 and D8 are also needed. The circuit shown in FIG. 1 thus comprises eight transistors, eight diodes, two inductors and two charge storage capacitors.

In the circuit of FIG. 1, the AC plasma display panel (ACPDP) employs the full bridge driver 10 to alternately impose a positive and a negative voltage on the panel (Cp) and sustain the image for a predetermined length of time. Since the PDP is a capacitive load, high peak currents are forced to flow in the switches comprising the full bridge, which can results in excessive losses, thereby reducing system efficiency. To reduce such losses and peak currents, the PDP sustain circuit as shown in FIG. 1 uses charge storage and recovery circuitry to reduce the peak currents.

With reference to FIG. 1, the cycle operates as follows: Initially, the panel Cp is charged in the positive direction as shown in FIG. 1 from the bus voltage source. Transistors Q2 an Q8 are initially turned on. The charge from Cp is transferred to capacitor C1 through inductor L1, diode D2, transistor Q2 and transistor Q8. Q2 and Q8 are then turned off. Q5 and Q4 are then turned on. With these transistors turned on the PDP indicated by Cp will now charge in the reverse direction from the charge stored on capacitor C2 via transistor Q5, diode D3 inductor L2 and transistor Q4. Cp is now charged in the reverse direction and Q5 is turned off. Transistor Q7 is then turned on and capacitor Cp is charged to the full bus voltage through transistor Q7 as well as transistor Q4 which is still turned on. Q7 is then turned off after a predetermined time and the PDP Cp is now fully charged in the reverse direction. Transistor Q6 is then turned on while transistor Q4 is still on. The charge on Cp is transferred to capacitor C2 via L2, D4, Q6 and Q4.

Transistors Q1 and Q8 are then turned on. The charge present on C1 is then transferred to Cp thereby again charging the panel in the opposite direction. The charge on capacitor C1 is transferred to Cp via transistor Q1, diode D1, inductor L1 and transistor Q8. At this point transistor Q4 is off. Transistor Q1 is now turned off and Q3 is turned on while Q8 remains on, thereby fully charging the plasma display panel capacitance to the full bus voltage in the initial direction. Q3 is then turned off after a predetermined time and the cycle repeats again so that Q2 and Q8 are turned on transferring the charge to capacitor C1 as previously described.

Components Q1, Q2, D1 and D2 serve as the bidirectional switch which transfers charge from Cp to C1 and back to Cp. Similarly, components Q5, Q6, D3 and D4 serve to transfer the charge between Cp and C2. These transistors are driven by half bridge drivers for example IR-2110 or IR-2113 half bridge drivers. The inductors L1 and L2 are required to ensure that most of the charge is transferred. In the absence of these inductors, only half of the charge will be transferred in either direction. Transferring most of the charge is highly desirable since a low voltage differential between Cp and the bus voltage will results in lower peak currents flowing through the fall bridge switches, reducing losses. The timing for the transfer is also critical. It has to be a sufficient length such that the current in the inductor is near zero, as this ensures that maximum charge is transferred in either direction. FIGS. 2 and 3 show a simulation of major components in the prior art bidirectional switch. As apparent, the voltage across C1 is at its maximum i.e., most of the charge has been transferred, when the voltage across Cp is minimum and the current in the inductor L1 is zero. Component and timing variations will inevitably cause a residual current to be present in the inductor at the end of the transfer period. The diodes D5, D6, D7 and D8 are included to dissipate this residual current but generate additional losses.

The circuit shown in FIG. 1 is complex and requires a significant number of components, as described, eight transistors, eight diodes, two storage capacitors and two inductors. The circuit is complex, expensive and suffers from unnecessary switching losses as a result of the large number of components.

It is desirable to provide a simpler, less expensive circuit that uses fewer components and suffers from fewer losses.

It is also desirable to provide an improved bi-directional switch which can be used in a PDP sustain driver circuit as well as in other applications.

SUMMARY OF THE INVENTION

It is an object of the present invention to provide an improved bi-directional switch and, in particular, a current sensing bi-directional switch.

It is yet still a further object of the present invention to provide an improved sustain driver for plasma display devices.

The above and other objects of the present invention are achieved by a bi-directional switch comprising: first and second semiconductor switching devices, a current sensor connected in series with the switching devices, thereby forming a series circuit, a driver circuit controlling the on/off operation of the first and second switching devices such that the first and second switching devices are substantially simultaneously turned on and off, the driver circuit turning the first and second switching devices on in response to a control input and turning the first and second switching devices off when current in the current sensor substantially drops to near a zero current.

The objects of the present invention are also achieved by a bidirectional switch comprising: at least one semiconductor switching device, a current sensor connected in series with the switching device, thereby forming a series circuit, a driver circuit controlling the on/off operation of the at least one switching device the driver circuit turning the switching device on in response to a control input and turning the switching device off when current in the current sensor substantially drops to near a zero current.

Further, the objects of the invention are also achieved by a discharge sustain driver circuit for a plasma display device, the driver circuit comprising: a first transistor switching circuit for switching a DC bus voltage across the plasma display device, a storage capacitance, at least one inductor; and first and second bi-directional switching circuits coupled in series and being coupled to the first switching circuit to transfer charge from the plasma display device through the at least one inductor to the storage capacitance, and back to the plasma display device; and a controller for the bi-directional switching circuits to control the bi-directional switching circuits so as to receive the charge on the storage capacitance and return the charge in an opposite charge direction to the plasma display device.

The objects of the invention are also achieved wherein the bi-directional switching circuits each include a current sensor and each turn off when current through the switching circuit is approximately zero.

The objects of the invention are furthermore achieved by a method of operating a discharge sustain driver circuit for a plasma display device, the driver circuit comprising a first transistor switching circuit for switching a DC bus voltage across the plasma display device, a storage capacitance, at least one inductor; and first and second bi-directional switching circuits coupled in series and being coupled to the first switching circuit to transfer charge from the plasma display device through the at least one inductance to the storage capacitor, and back to the plasma display device, and a controller for the bidirectional switching circuits to control the bidirectional switching circuits so as to receive the charge on the storage capacitance and return the charge in an opposite charge direction to the plasma display device; and wherein the first switching comprises a full bridge switching circuit, the full bridge switching circuit comprising first and second series connected transistors connected across the DC bus and third and fourth series connected transistors connected across the DC bus; wherein the first and third transistors are high side connected and the second and fourth are low side connected; the plasma display device being connected across a common connection of the first and second transistors and a common connection of the third and fourth transistors, and wherein the first and second bi-directional switches are coupled in series together, and wherein the storage capacitance and the at least one inductor are coupled in a series circuit across the second bi-directional switch, the method comprising: turning on the first and fourth transistors to substantially charge the display device to the bus voltage; turning off the first and fourth transistors when the display device has changed to substantially the bus voltage; turning on the first bi-directional switch to transfer the charge on the display device to the storage capacitance; turning off the first bi-directional switch when the current through the switch is substantially zero; turning on the second bi-directional switch to reverse the charge across the storage capacitance; turning off the second bi-directional switch when the current therethrough is substantially zero; turning on the first bi-directional switch to transfer the reverse charge on the storage capacitance to the display device; turning on the second and third transistors to fully charge the display device to substantially the bus voltage in the reverse direction; turning off the second and third transistors when the display device has charged to substantially the bus voltage; turning on the first bi-directional switch to transfer the reverse charge on the display device to the storage capacitance; turning off the first bi-directional switch when the current through the switch is substantially zero; turning on the second bi-directional switch to again reverse the charge across the storage capacitance; turning off the second bi-directional switch when the current therethrough is substantially zero; turning on the first bi-directional switch to transfer the charge on the storage capacitance to the display device; and repeating the above steps as long as desired to sustain a discharge in the display device.

Other features and advantages of the present invention will become apparent from the following description of the invention which refers to the accompanying drawings.

BRIEF DESCRIPTION OF THE DRAWING(S)

The invention will now be described in greater detail in the following detailed description with reference to the drawings in which.

DETAILED DESCRIPTION OF THE INVENTION

Figure 4A:
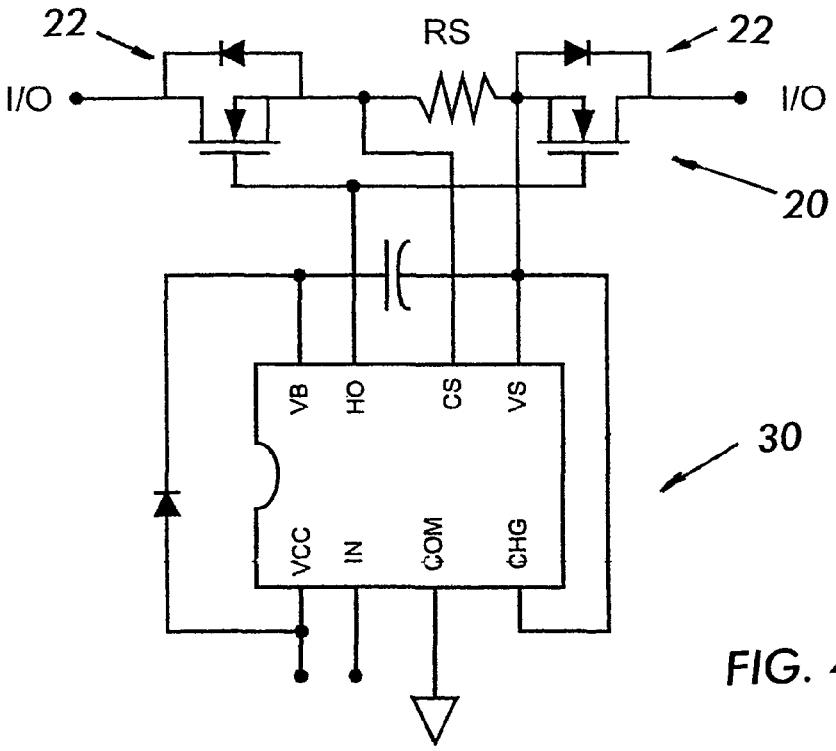
FIG. 4A shows the current sensing bi-directional switch according to the present invention.
Figure 5:
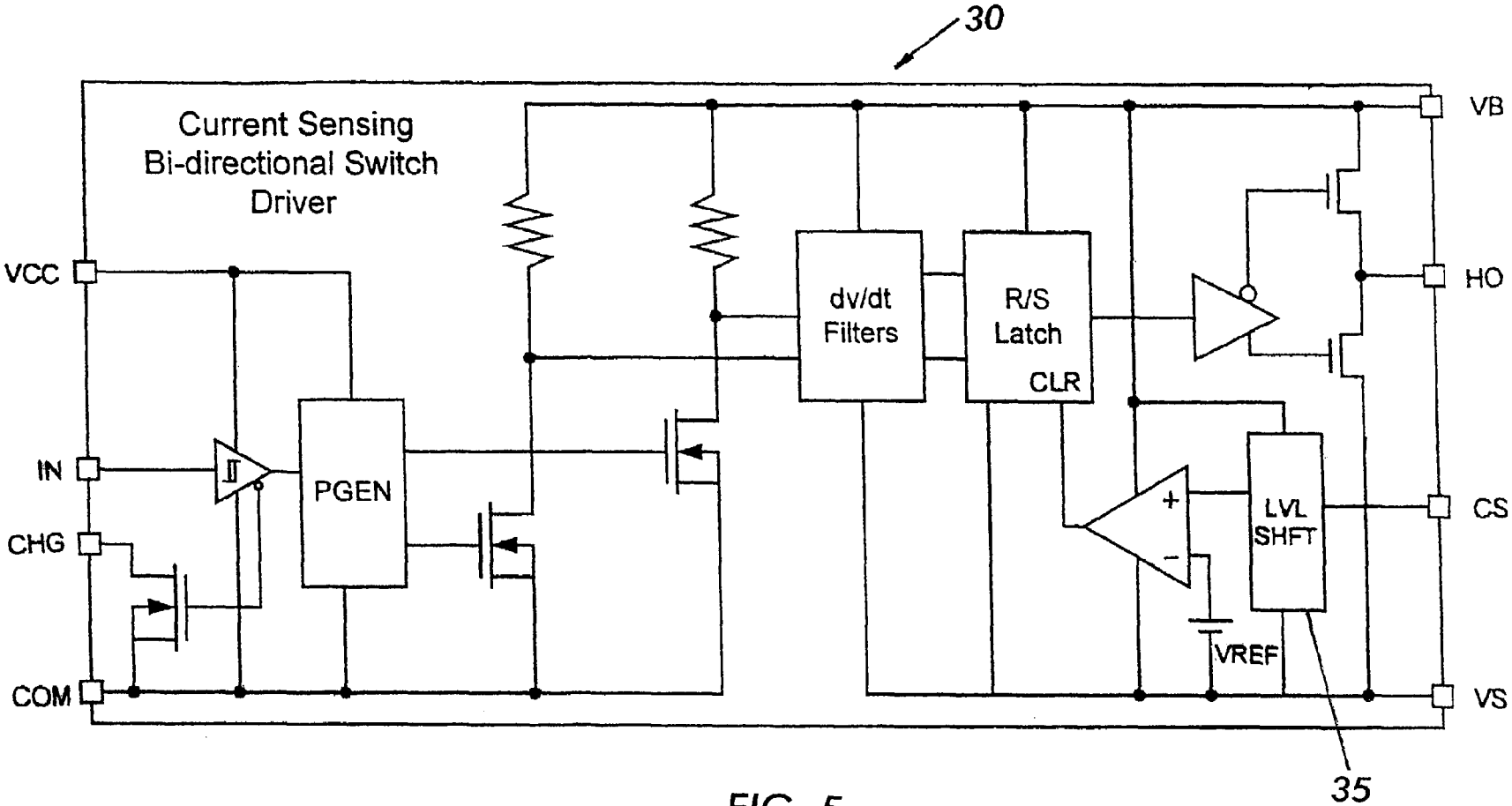
FIG. 5 shows block diagram for the bi-directional switch driver for the circuit of FIG. 4A.

With reference again to the drawings, FIG. 4A shows the current sensing bi-directional switch according to the present invention. In the embodiment shown, the bi-directional switch 20 employs two common source, N channel MOSFETs 22 and a driver IC 30. Both N channel FETs are turned on and off simultaneously so the gates are commonly connected to the driver 30 output HO. The switch is activated externally through an ON pulse on the controller IN terminal. A series resistor RS of approximately 10 milli ohms is used to sense the current in the switch. The switch is turned off automatically when the current approaches zero, indicating a complete transfer of charge from one input/output (I/O) to the other. The block diagram for the switch controller is shown in FIG. 5. FIG. 4A shows waveforms at the input IN, at the current sense input CS and at the output HO with respect to VS, the source voltage. The terminals of the controller 30 include VCC which is the input logic supply voltage, IN which is the logic input for the high side gate driver, COM which is the low side logic supply return, CHG which is a bootstrap capacitor charging input, VB which is the high side floating supply, HO which is the high side output, CS which is the high side current sense input and VS which is the high side floating supply return.

Figure 4B:
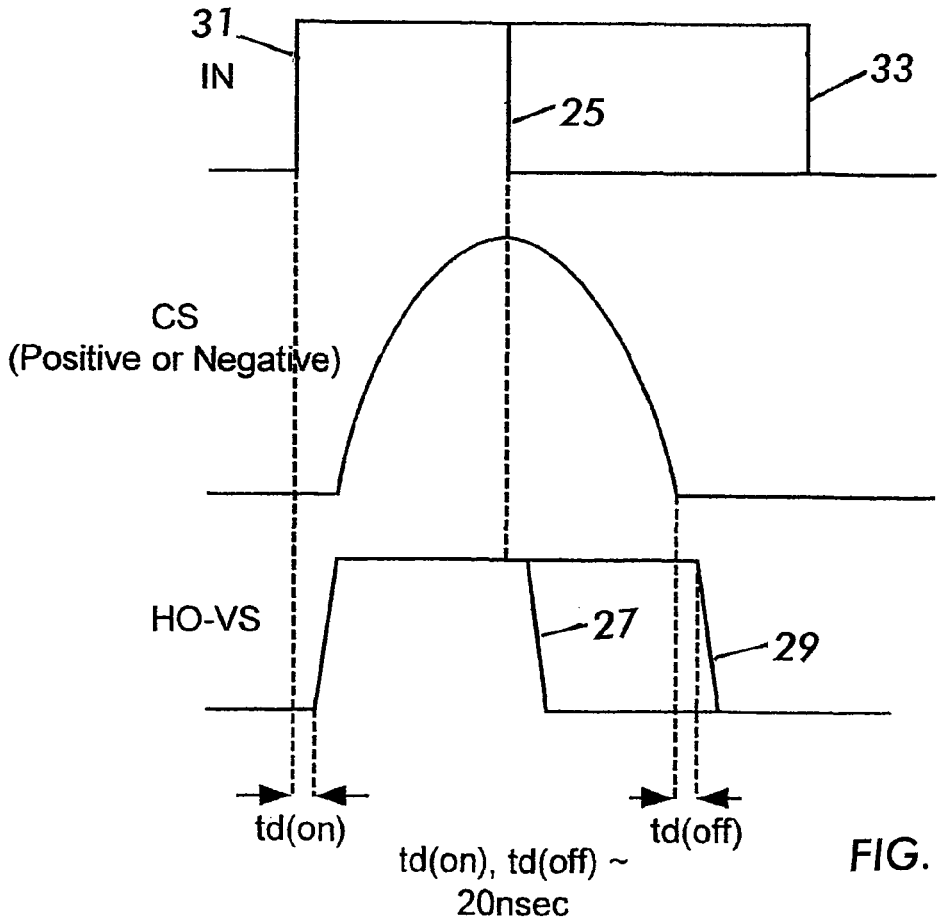
FIG. 4B shows waveforms for the circuit of FIG. 4A.

With reference to FIG. 5, the controller block diagram utilizes mostly conventional circuitry including MOSFETs, Schmidtt triggers, pulse generators, dv/dt filters, an RS latch, level shifters, comparators and amplifiers, and will not be described in detail herein. When an input is received as shown in FIG. 4A on the input IN, the output HO will go high after a delay td (on). An exemplary wave form is shown in FIG. 4A for the current sense input CS, which is proportional to the current in resistor RS. When the current sense returns to zero, after a delay td(off), the output HO goes low turning off the MOSFETs 22. The output HO automatically shuts down at the next current zero crossing through the sense resistor in series with the MOSFETs. The output HO can also be turned off by a logic zero at the IN terminal. This is shown in FIG. 4B at 25. With an input IN is received which goes to zero before the current sense input goes to zero, the HO output will go to zero as shown at 27. Otherwise, the output HO will go to zero at the next current zero crossing, as shown in FIG. 4B at 29.

Figure 1:
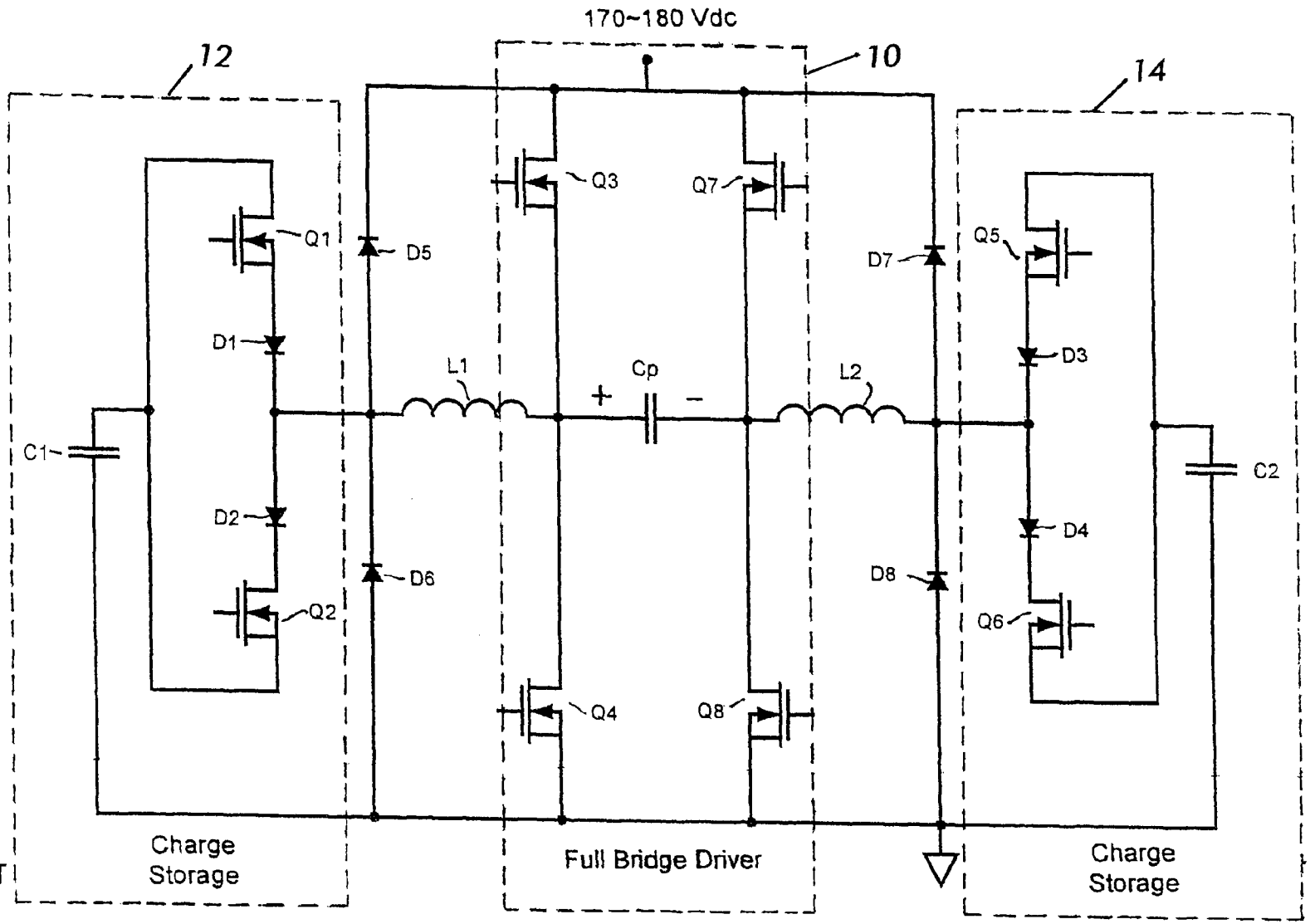
FIG. 1 PRIOR ART
FIG. 1 shows a prior art PDP sustain driver circuit.
Figure 2:
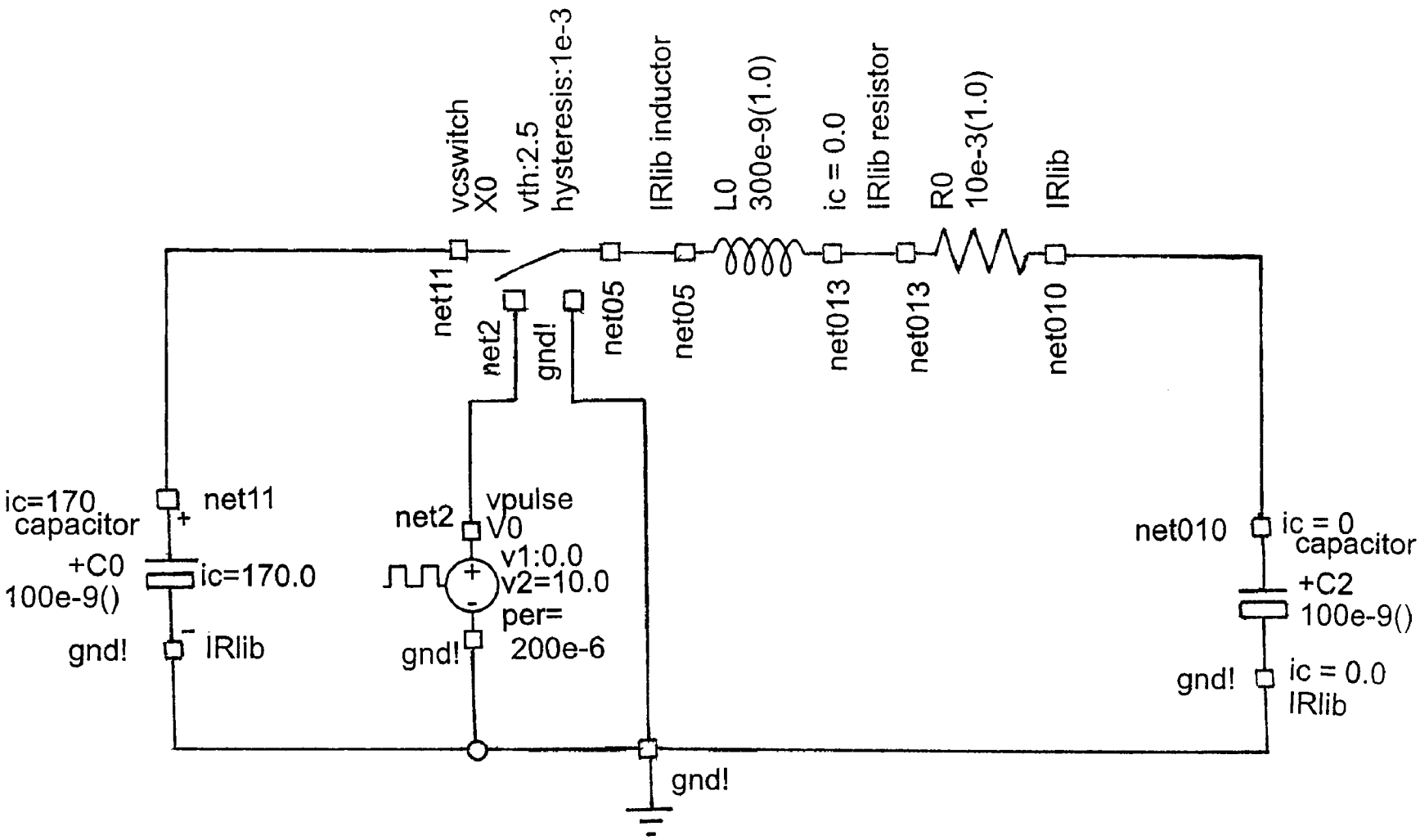
FIG. 2 shows a circuit used in simulating charge transfer from the PDP to a charge storage capacitor for the circuit of FIG. 1.
Figure 3:
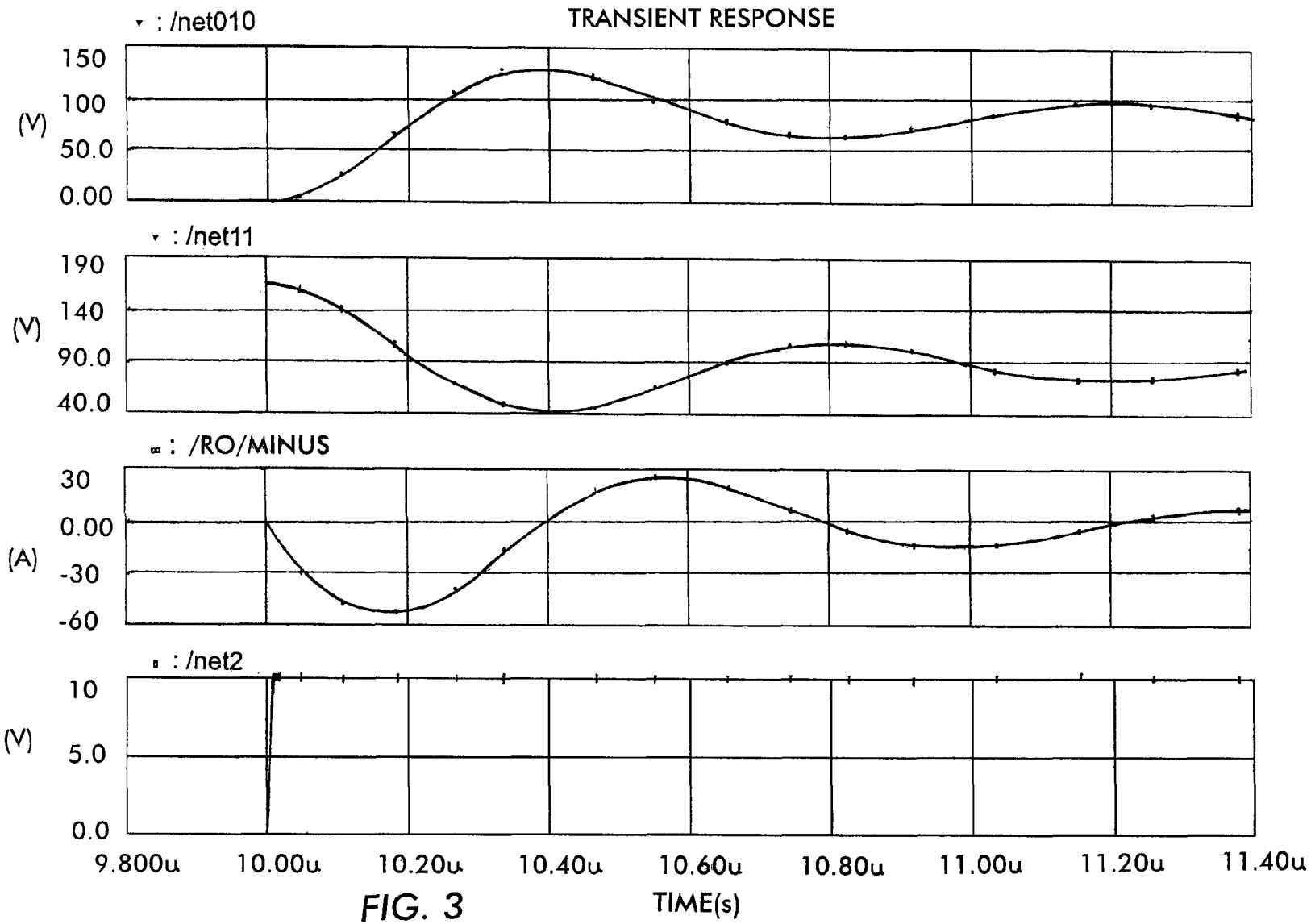
FIG. 3 shows simulation results of transferring the charge from the PDP to the storage capacitor including the voltage across the storage capacitor, the voltage across the PDP Cp, current in the inductor L1 and starting pulse.

Turning again to FIG. 4A, since the current can flow in both directions in the switch, a level shift function circuit 35 is employed in the current sensing circuitry as shown in FIG. 5 to assist in detecting the zero crossing in both directions. This arrangement of the bidirectional switches in results in that the diodes D1, D2, D3 and D4 in series with the MOSFETs Q1, Q2, Q3 and Q4 in the circuit of FIG. 1 are not necessary. In addition, diodes D5, D6, D7 and D8 are also not necessary since the residual current in the inductors L1 and L2 are low under all component/input pulse width variations. The only requirement is that the input pulse width be wider than that required to fully transfer the charge. Thus, the input pulse IN should be longer than the pulse width at the input CS, the zero crossing of which indicates when the charge has been fully transferred. See FIG. 4B, and in particular, see that IN from 31 to 33 is longer in time than pulse CS. Further, increased system efficiency is provided by the circuit of FIG. 4A due to the complete transfer of charge from the panel to the storage capacitor and back.

Figure 6:
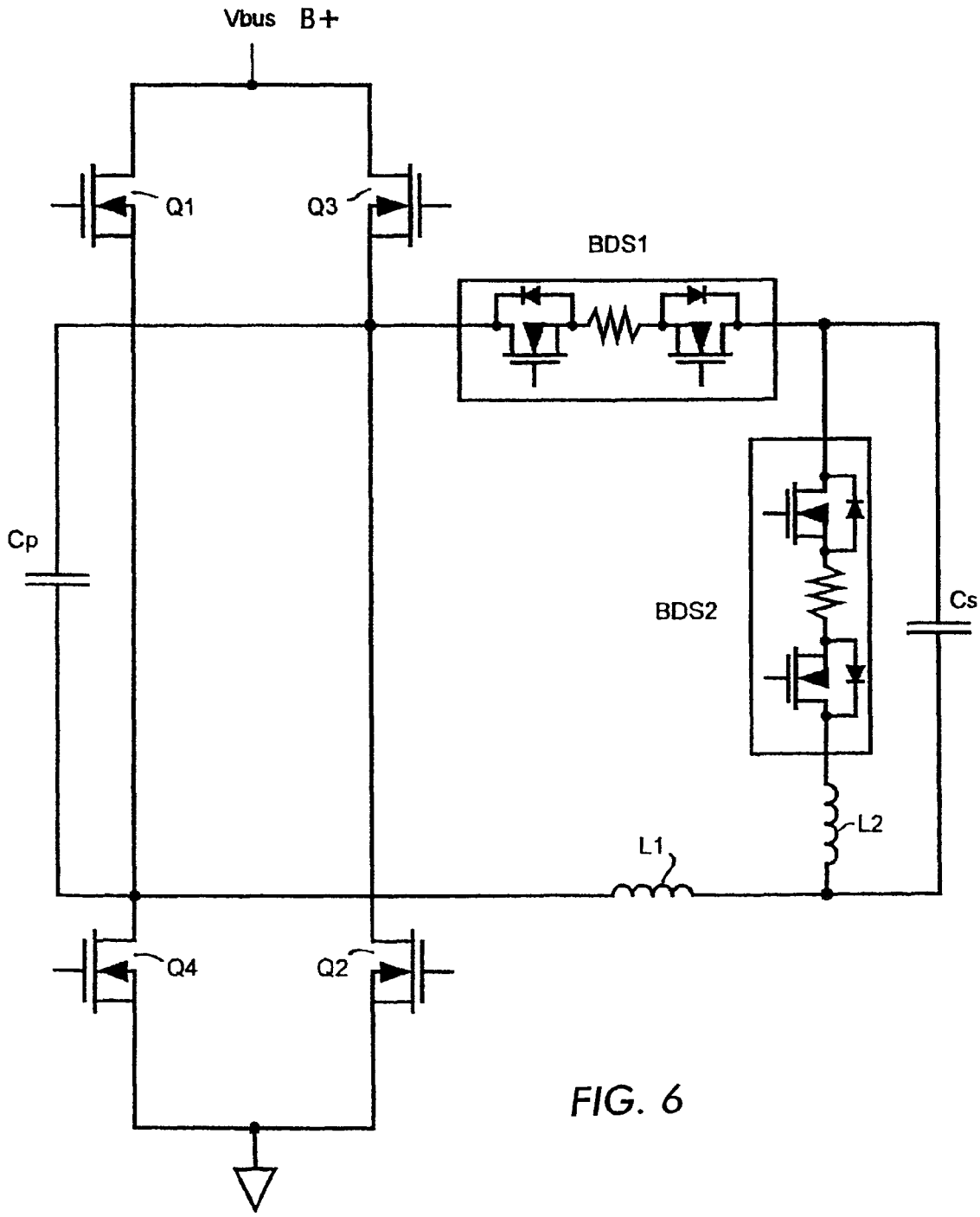
FIG. 6 shows a PDP sustain circuit of the present invention using the bi-directional switches of the present invention.

FIG. 6 shows a PDP sustain driver circuit utilizing the bi-directional switches according to the present invention. As shown, the sustain driver circuit employs a full bridge comprising transistors Q1, Q2, Q3 and Q4 and a single storage capacitor Cs, along with two bi-directional switches identified as BDS1 and BDS2 together with inductors L1 and L2. The circuit eliminates the diodes D1-D8 as well as one of the storage capacitors. In another embodiment described with reference to FIG. 7, only a single inductor is necessary.

With reference to FIG. 6, the operation of the circuit is as follows: initially, transistors Q3 and Q4 are turned on. This causes the display Cp panel to charge up through transistors Q3 and Q4 to the full bus voltage. Q3 and Q4 are then turned off. Bi-directional switch BDS1 is then turned on and charge is transferred from the display Cp to the storage capacitor Cs via BDS1 and inductor L1. BDS1 turns off automatically in accordance with FIG. 4B at the current zero crossing when the charge transferred to Cs is complete. BDS2 is then turned on and the charge in Cs flows through BDS2 into inductor L2. When the current in L2 and thus is BDS2 is zero, the charge cross the resonant circuit comprising Cs and L2 is reversed and BDS2 goes off. BDS1 is then turned on and the oppositely charged capacitor Cs now transfers its charge through BDS1 and L1 to Cp which is connected directly across the series circuit comprising BDS1, Cs and L1. Q1 and Q2 are then turned on and the reverse voltage across Cp further charges Cp to the full bus voltage. Q1 and Q2 are then turned off and BDS1 and BDS2 are again used to transfer the charge stored in Cp to Cs and reverse it. Hence, the oppositely charged voltage on Cp is transferred to Cs by turning on BDS1 which goes off once the charge has been fully transferred. BDS2 is then turned on to again reverse the charge on Cs. BDS2 goes off once the charge has been reversed and the charge is now provided across Cp again in the opposite direction. Then the cycle repeats, that is, Q3 and Q4 are turned on to charge Cp fully to the full bus voltage and the switches BDS1 and BDS2 are used to transfer the charge and reverse it.

The circuit according to FIG. 6 uses nine less components (the diodes D1 to D8 of FIG. 1 and one of the storage capacitors are eliminated than the original circuit of FIG. 1. Furthermore, the switch losses are reduced since efficient change transfer between Cp and CS reduces two current in the full bridge.

Figure 7:
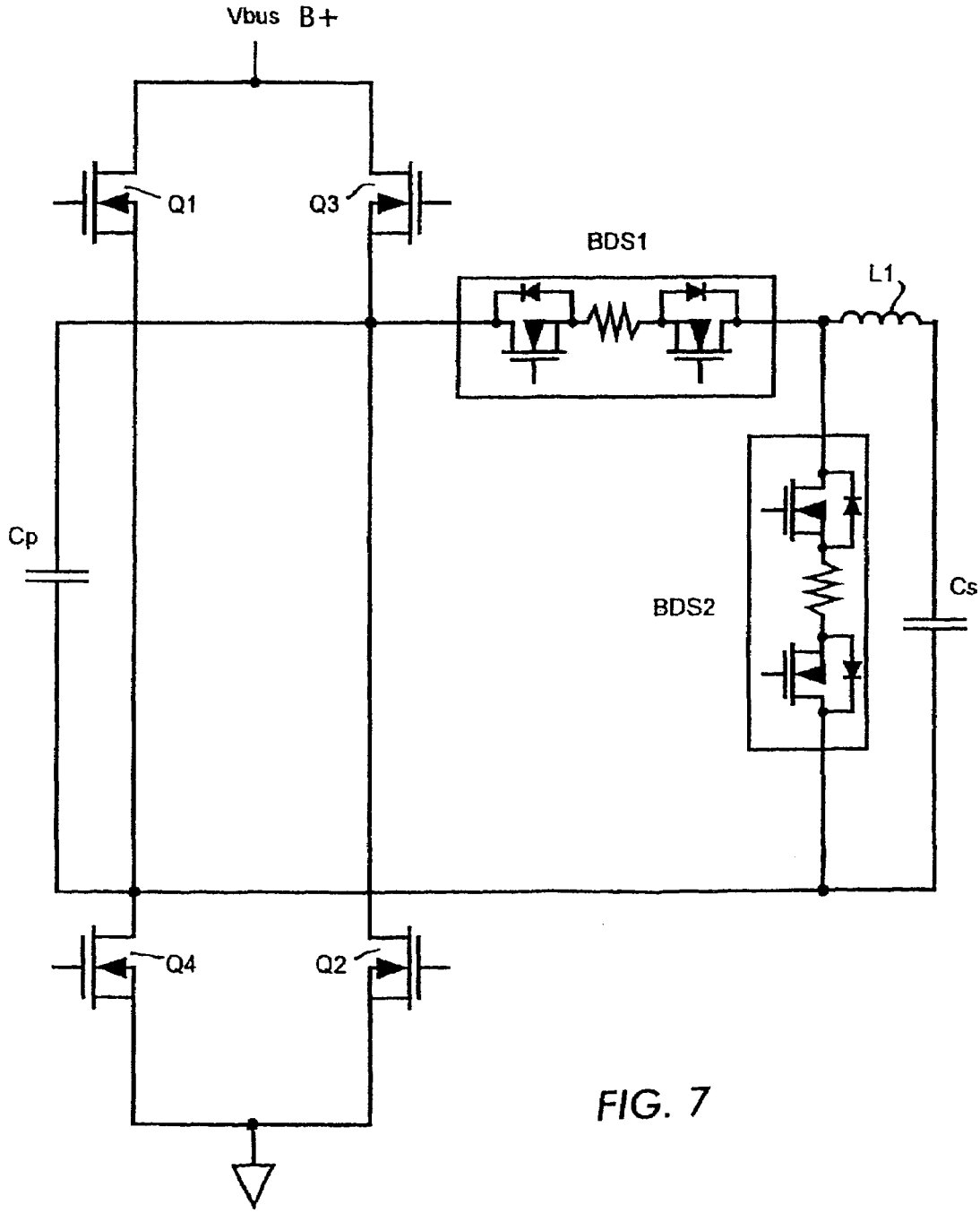
FIG. 7 shows a variation of the circuit of FIG. 6 using only one inductor.

FIG. 7 describes an alternative circuit using only a single inductor L1. Similarly to the circuit of FIG. 6, Q3 and Q4 first charge Cp to the full bus voltage, and are then turned off. BDS1 is then turned on to charge Cs. When the charge on Cp is transferred to Cs, BDS1 turns off. BDS2 is then turned on and the charge on Cs is reversed through L1 and then BDS2 turns off. BDS1 is then turned on and the charge is transferred from the reversely charged Cs to Cp, thereby charging Cp oppositely. Q1 and Q2 are then turned on to fully charge Cp to the full bus voltage in the reverse direction. Then Q1 and Q2 are turned off and BDS1 is turned on to charge Cs. Once Cs has been fully charged in the opposite direction, BDS1 turns off and BDS2 is turned on, thus reversing the charge again across Cs. BDS2 then turns off and BDS1 is turned on to charge Cp again in the original direction and the cycle repeats.

There has thus been described a current sensing bi-directional switch and an efficient sustain driver circuit for a plasma display device.

Although the present invention has been described in relation to particular embodiments thereof, many other variations and modifications and other uses will become apparent to those skilled in the art. Therefore, the present invention should be limited not by the specific disclosure herein, but only by the appended claims.

What is claimed is:

1. A discharge sustain driver circuit for a plasma display device, the discharge sustain driver circuit comprising:

a first transistor switching circuit for switching a DC bus voltage across the plasma display device;

a storage capacitance;

at least one inductor; and first and second bi-directional switching circuits coupled in series and being coupled to the first transistor switching circuit to transfer charge from the plasma display device through the at least one inductor to the storage capacitance, and back to the plasma display device; and a controller for the first and second bi-directional switching circuits to control the first and second bi-directional switching circuits so as to receive the charge on the storage capacitance and return the charge in an opposite charge direction to the plasma display device.

2. The discharge sustain driver circuit of claim 1, wherein the first transistor switching circuit comprises a full bridge transistor switching circuit.

3. The discharge sustain driver circuit of claim 1, wherein the storage capacitance comprises a single storage capacitor or a plurality of parallel connected storage capacitors.

4. The discharge sustain driver circuit of claim 1, wherein the first and second bi-directional switching circuits each include a current sensor and each turn off when current through the respective bi-directional switching circuit is approximately zero.

5. The discharge sustain driver circuit of claim 1, wherein the first and second bi-directional switching circuits each comprise two series connected semiconductor switches that are turned on substantially simultaneously.

6. The discharge sustain driver circuit of claim 5, further comprising a current sensor in series with the two series connected semiconductor switches.

7. The discharge sustain driver circuit of claim 6, wherein the current sensor comprises a resistor.

8. The discharge sustain driver circuit of claim 1, wherein the at least one inductor comprises first and second inductors in series with both the first and second bi-directional switching circuits, and the storage capacitance is connected in parallel with a series connection of one of the first and second bi-directional switching circuits and the second inductor.

9. The discharge sustain driver circuit of claim 1, wherein the at least one inductor is connected in a series circuit with the storage capacitance, and the series circuit of the storage capacitance and at least one inductor is connected in parallel with one of the first and second bi-directional switching circuits.

10. The discharge sustain driver circuit of claim 2, wherein the full bridge transistor switching circuit comprises first and second transistors connected in series that are connected across the DC bus and third and fourth transistors connected in series that are connected across the DC bus;

wherein the first and third transistors are high side connected and the second and fourth transistors are low side connected;

the plasma display device being connected across a common connection of the first and second transistors and a common connection of the third and fourth transistors, and wherein the first and second bi-directional switching circuits are coupled in series together and in series with first and second inductors, the storage capacitance being connected across a series connection of the second bi-directional switching circuit and the second inductor;

the discharge sustain driver circuit's operation comprising:

turning on the first and fourth transistors to charge the plasma display device substantially to the DC bus voltage;

turning off the first and fourth transistors when the plasma display device has charged to substantially the DC bus voltage;

turning on the first bi-directional switching circuit to transfer the charge on the plasma display device to the storage capacitance;

turning off the first bi-directional switching circuit when the charge transfer is substantially complete;

turning on the second bi-directional switching circuit to reverse the charge across the storage capacitance;

turning off the second bi-directional switching circuit when the current in the second bi-directional switching circuit is substantially zero;

turning on the first bi-directional switching circuit to transfer the reversed charge on the storage capacitance to the plasma display device;

turning on the second and third transistors to further charge the plasma display device substantially to the DC bus voltage in a reverse direction;

turning off the second and third transistors when the plasma display device has charged to substantially the DC bus voltage;

turning on the first bi-directional switching circuit to transfer charge from the plasma display device to the storage capacitance;

turning on the second bi-directional switching circuit to again reverse the charge across the storage capacitance;

turning off the second bi-directional switching circuit when current in the second bi-directional switching circuit is substantially zero;

turning on the first bi-directional switching circuit to transfer the again reversed charge on the storage capacitance to the plasma display device; and repeating the above as long as desired to sustain a discharge in the plasma display device.

11. The discharge sustain driver circuit of claim 10, wherein the first and second bi-directional switching circuits automatically turn off when the current through the respective bi-directional switching circuit is substantially zero.

12. The discharge sustain driver circuit of claim 10, wherein all of the first, second, third, and fourth transistors are MOSFETs and the first and second bi-directional switching circuits employ MOSFETs.

13. The discharge sustain driver circuit of claim 2, wherein the full bridge switching circuit comprises first and second transistors connected in series that are connected across the DC bus and third and fourth transistors connected in series that are connected across the DC bus;

wherein the first and third transistors are high side connected and the second and fourth transistors are low side connected;

the plasma display device being connected across a common connection of the first and second transistors and a common connection of the third and fourth transistors, and wherein the first and second bi-directional switching circuits are coupled in series together, and wherein the storage capacitance and the at least one inductor are coupled in a series circuit across the second bi-directional switching circuit;

the discharge sustain driver circuit's operation comprising:

turning on the first and fourth transistors to substantially charge the plasma display device to the DC bus voltage;

turning off the first and fourth transistors when the plasma display device has charged to substantially the DC bus voltage;

turning on the first bi-directional switching circuit to transfer the charge on the plasma display device to the storage capacitance;

turning off the first bi-directional switching circuit when the current therethrough is substantially zero;

turning on the second bi-directional switching circuit to reverse the charge across the storage capacitance;

turning off the second bi-directional switching circuit when the current therethrough is substantially zero;

turning on the first bi-directional switching circuit to transfer the reversed charge on the storage capacitance to the plasma display device;

turning on the second and third transistors to fully charge the plasma display device to substantially the DC bus voltage in a reverse direction;

turning off the second and third transistors when the plasma display device has charged to substantially the DC bus voltage;

turning on the first bi-directional switching circuit to transfer the reversed charge on the plasma display device to the storage capacitance;

turning off the first bi-directional switching circuit when the current therethrough is substantially zero;

turning on the second bi-directional switching circuit to again reverse the charge across the storage capacitance;

turning off the second bi-directional switching circuit when the current therethrough is substantially zero;

turning on the first bi-directional switching circuit to transfer the charge on the storage capacitance to the plasma display device; and repeating the above as long as desired to sustain a discharge in the plasma display device.

14. The discharge sustain driver circuit of claim 13, wherein the first and second bi-directional switching circuits automatically turn off when the current through the respective bi-directional switching circuit is substantially zero.

15. The discharge sustain driver circuit of claim 13, wherein all of the first, second, third, and fourth transistors are MOSFETs and the first and second bi-directional switching circuits employ MOSFETs.

16. The discharge sustain driver circuit of claim 1, wherein the first and second bi-directional switching circuits each comprise:

first and second semiconductor switching devices;

a current sensor connected in series with the first and second semiconductor switching devices, thereby forming a series circuit;

a driver circuit controlling the on/off operation of the first and second semiconductor switching devices such that the first and second semiconductor switching devices are substantially simultaneously turned on and off, the driver circuit turning the first and second semiconductor switching devices on in response to a control input and turning the first and second semiconductor switching devices off when current in the current sensor substantially drops to near a zero current.

17. The discharge sustain driver circuit of claim 1, wherein the first and second bi-directional switching circuits each comprise:

at least one semiconductor switching device;

a current sensor connected in series with the at least one semiconductor switching device, thereby forming a series circuit;

a driver circuit controlling the on/off operation of the at least one semiconductor switching device, the driver circuit turning the at least one semiconductor switching device on in response to a control input and turning the at least one semiconductor switching device off when current in the current sensor substantially drops to near a zero current.

18. A discharge sustain driver circuit for a plasma display device, the driver circuit comprising:

a first transistor switching circuit for switching a DC bus voltage across the plasma display device;

a storage capacitance;

at least one inductor; and first and second bi-directional switching circuits coupled in series and being coupled to the first transistor switching circuit to transfer charge from the plasma display device trough the at least one inductor to the storage capacitance, and back to the plasma display device; and a controller to control the first and second bi-directional switching circuits so as to receive charge on the storage capacitance and return the charge in an opposite charge direction to the plasma display device, the first and second bi-directional switching circuits turning off when a substantially zero current flows through the respective bi-directional switching circuit.

19. A discharge sustain driver circuit for a plasma display device, the driver circuit comprising:

a first transistor switching circuit for switching a DC bus voltage across the plasma display device;

a storage capacitance;

at least one inductor; and first and second bi-directional switching circuits coupled in series and being coupled to the first transistor switching circuit to transfer charge from the plasma display device through the at least one inductor to the storage capacitance, and back to the plasma display device; and a controller to control the first and second bi-directional switching circuits so as to receive the charge on the storage capacitance and return the charge in an opposite charge direction to the plasma display device, further wherein the storage capacitance comprises a single storage capacitor or a plurality of parallel connected storage capacitors.

20. A method of operating a discharge sustain driver circuit for a plasma display device, the driver circuit comprising a first transistor switching circuit for switching a DC bus voltage across the plasma display device, a storage capacitance, at least one inductor;

and first and second bi-directional switching circuits coupled in series and being coupled to the first transistor switching circuit to transfer charge from the plasma display device through the at least one inductor to the storage capacitance, and back to the plasma display device;

and a controller to control the first and second bi-directional switching circuits so as to receive the charge on the storage capacitance and return the charge in an opposite charge direction to the plasma display device and wherein the first transistor switching circuit comprises a full bridge switching circuit, the full bridge switching circuit comprising first and second transistors connected in series that are connected across the DC bus and third and fourth transistors connected in series that are connected across the DC bus;

wherein the first and third transistors are high side connected and the second and fourth transistors are low side connected;

the plasma display device being connected across a common connection of the first and second transistors and a common connection of the third and fourth transistors, and wherein the first and second bi-directional switching circuits are coupled in series together and in series with first and second inductors, the storage capacitance being connected across a series connection of the second bi-directional switching circuit and the second inductor;

the method comprising:

turning on the first and fourth transistors to charge the plasma display device to substantially the DC bus voltage;

turning off the first and fourth transistors when the plasma display device has charged to substantially the DC bus voltage;

turning on the first bi-directional switching circuit to transfer the charge on the plasma display device to the storage capacitance;

turning off the first bi-directional switching circuit when the charge transfer is substantially complete;

turning on the second bi-directional switching circuit to reverse the charge across the storage capacitance;

turning off the second bi-directional switching circuit when the current in the second bi-directional switching circuit is substantially zero;

turning on the first bi-directional switching circuit to transfer the reversed charge on the storage capacitance to the plasma display device;

turning on the second and third transistors to further charge the plasma display device substantially to the DC bus voltage in a reverse direction;

turning off the second and third transistors when the plasma display device has charged to substantially the DC bus voltage;

turning on the first bi-directional switching circuit to transfer charge from the plasma display device to the storage capacitance;

turning on the second bi-directional switching circuit to reverse the charge across the storage capacitance;

turning off the second bi-directional switching circuit when the current in the second bi-directional switching circuit is substantially zero;

turning on the first bi-directional switching circuit to transfer the again reversed charge on the storage capacitance to the plasma display device; and repeating the above as long as desired to sustain a discharge in the plasma display device.

21. The method of claim 20, wherein the first and second bi-directional switching circuits automatically turn off when the current through the respective bi-directional switching circuit is substantially zero.

22. A method of operating a discharge sustain driver circuit for a plasma display device, the driver circuit comprising a first transistor switching circuit for switching a DC bus voltage across the plasma display device, a storage capacitance, at least one inductor;

and first and second bi-directional switching circuits coupled in series and being coupled to the first transistor switching circuit to transfer charge from the plasma display device through the at least one inductance to the storage capacitor, and back to the plasma display device, and a controller to control the first and second bi-directional switching circuits so as to receive the charge on the storage capacitance and return the charge in an opposite charge direction to the plasma display device;

and wherein the first transistor switching circuit comprises a full bridge switching circuit, the full bridge switching circuit comprising first and second transistors connected in series that are connected across the DC bus and third and fourth transistors connected in series that are connected across the DC bus;

wherein the first and third transistors are high side connected and the second and fourth transistors are low side connected;

the plasma display device being connected across a common connection of the first and second transistors and a common connection of the third and fourth transistors, and wherein the first and second bi-directional switching circuits are coupled in series together, and wherein the storage capacitance and the at least one inductor are coupled in a series circuit across the second bi-directional switching circuit;

the method comprising:

turning on the first and fourth transistors to substantially charge the plasma display device to the DC bus voltage;

turning off the first and fourth transistors when the plasma display device has changed to substantially the DC bus voltage;

turning on the first bi-directional switching circuit to transfer the charge on the plasma display device to the storage capacitance;

turning off the first bi-directional switching circuit when the current therethrough is substantially zero;

turning on the second bi-directional switching circuit to reverse the charge across the storage capacitance;

turning off the second bi-directional switching circuit when the current therethrough is substantially zero;

turning on the first bi-directional switching circuit to transfer the reversed charge on the storage capacitance to the plasma display device;

turning on the second and third transistors to fully charge the plasma display device to substantially the DC bus voltage in a reverse direction;

turning off the second and third transistors when the plasma display device has charged to substantially the DC bus voltage;

turning on the first bi-directional switching circuit to transfer the reversed charge on the plasma display device to the storage capacitance;

turning off the first bi-directional switching circuit when the current therethrough is substantially zero;

turning on the second bi-directional switching circuit to again reverse the charge across the storage capacitance;

turning off the second bi-directional switching circuit when the current therethrough is substantially zero;

turning on the first bi-directional switching circuit to transfer the charge on the storage capacitance to the plasma display device; and repeating the above as long as desired to sustain a discharge in the plasma display device.

23. The method of claim 22, wherein the first and second bi-directional switching circuits automatically turn off when the current through the respective bi-directional switching circuit is substantially zero.

* * * * *